United States Patent [19]

Goldammer et al.

[11] 4,070,814

[45] Jan. 31, 1978

[54] APPARATUS FOR ARRESTING THE ROTOR IN AN OPEN-END SPINNING MACHINE

[75] Inventors: Georg Goldammer, Geimersheim; Kurt Beitzinger, Ingolstadt, both of Germany

[73] Assignee: SKF Kugellagerfabriken GmbH, Schweinfurt, Germany

[21] Appl. No.: 693,181

[22] Filed: June 7, 1976

[30] Foreign Application Priority Data

June 7, 1975 Germany ..... 2525435

[51] Int. Cl.[2] ..... D01H 1/241

[52] U.S. Cl. ..... 57/89; 57/58.89; 57/105

[58] Field of Search ..... 57/58.89, 88–89, 57/104–105

[56] References Cited

U.S. PATENT DOCUMENTS

| | | | |
|---|---|---|---|
| 3,375,649 | 4/1968 | Bures et al. | 57/89 X |
| 3,543,500 | 12/1970 | Bancroft et al. | 57/89 X |
| 3,662,532 | 5/1972 | Stahlecker | 57/58.89 |
| 3,765,161 | 10/1973 | Kohler | 57/105 X |
| 3,805,506 | 4/1974 | Stahlecker | 57/105 X |
| 3,846,967 | 11/1974 | Braun | 57/104 X |
| 3,868,815 | 3/1975 | Stahlecker | 57/88 |

FOREIGN PATENT DOCUMENTS

| | | | |
|---|---|---|---|
| 790,122 | 2/1958 | United Kingdom | 57/89 |

*Primary Examiner*—Richard C. Queisser
*Assistant Examiner*—Charles Gorenstein

[57] ABSTRACT

Stopping means for an open-end spinning turbine comprises a lever pivotable beneath the shaft of the turbine and the drive belt for the shaft. The lever moves toward the belt and the shaft to sequentially lift the belt off the shaft and lift the shaft from its support rollers.

9 Claims, 3 Drawing Figures

APPARATUS FOR ARRESTING THE ROTOR IN AN OPEN-END SPINNING MACHINE

It is well known to use backing rolls for supporting the shaft of an open end spinning machine, and to operate the shaft directly by means of a tangential belt. Thus, it was already proposed to hold the rotorshaft within the slot which is formed between the tangential belt and a guide or backing roll which is formed as a twin or paired set of rolls (DT-OS No. 2,042.972). The stopping of the rotor happens when the rotorshaft is pressed against brake linings, surrounding the shaft with a close clearance by a brakeshoe which is connected to an actuating lever. The backing roll for the belt may in addition be separately lowered in relation to the belt so that the belt be relieved of tension. In another embodiment, the shaft is simultaneously pressed against the brake linings, by an also spring-actuated guide-roll which secures the position of the rotorshaft, while contact pressure of the belt is reduced by the lowering of the also spring-actuated belt backing roll. It is a disadvantage of this device that the tangential belt forms one of the bearing points of the rotor shaft and that said belt is liable to develop strong vibrations due to the high r.p.m. This does not ensure an exact positioning of the rotorshaft in a radial direction, which is needed for spinning, not even when the rotorshaft is pulled or pressed by an additional force into the slot between the tangential belt and the guiding roll by a backing roll disposed in the vicinity of the rotor-shaft. The reliability of the device becomes doubtful because the rotorshaft is liable to touch the brake linings which are so close to it due to the radially unstable position of the shaft. This possibility is not removed by the basically opposite action of the spring-actuated belt-backing-roll and the shaft-guide-roll against the rotorshaft, but it becomes even more probable due to the working conditions of both springs which are bound to differ. On stopping, the danger exists that the tangential belt increases in its vibrations when it is released and is now only incompletely guided within the area of the rotorshaft. That may cause it to abut unto the rotorshaft and may cause rotation of said shaft together with the rotor, overcoming the braking action of the brake linings. This danger is increased considerably when a spring-actuated guide roll is disposed so that said roll presses unto the shaft in the direction of the belt, and particularly when the brake linings show signs of use so that the rotorshaft is moved still nearer towards the belt. This counteracts the demands of safety just as well as the independently actuated contact pressure of the rotorshaft against the brake linings by means of the brakeshoes and the relief of the tangential belt. An accident or at least a premature erosion of the device may occur when the operator does not actuate both manipulations in their preordained sequence or if the operator forgets one of them.

It is furthermore well known to support the shaft of the rotor of an open end spinning device within the groove which is formed by the backing rolls and to actuate said rotor by means of a tangential belt, while the belt simultaneously presses the rotorshaft against the backing rolls (DT-OS No. 1,901,453). This has in comparison to the aforementioned device the advantage that the position of the rotorshaft is solidly fixed in a radial direction. In order to stop the rotor, said rotor has to be moved away from the belt together with its bearing and the backing rolls, or the belt is released by swiveling away of its backing roll, or a special lifting roll lifts the belt off the rotorshaft. No additional braking means are provided so that a quick stopping of the rotor, needed for safety and production, is not possible.

According to another proposal (DT-OS No. 2,141,276), the rotorshaft, which is supported within the groove by pairs of supporting rolls and which is driven by a tangential belt, is stopped by the pressure of a brake lining against the shaft. Hereby, the brake lever, which is furnished with the brake lining, is connected to a lever which carries the belt-pressing-on-roll in such a way that the reaction force which acts upon the brake linings during braking, is transferred as a lift-off force upon the press-on roll. Such a device allows a fast stopping of the machine but leads also to a premature wear of the machine, because the braking power is also used for the lift-off of the press-on roll.

It is the objective of the present invention to create a device while preventing the disadvantages of the already known device, which makes possible a fast and material-conserving stopping of a rotor which is supported and driven according to the general idea of claim 1, said stopping occurring in predetermined sequence of separation of the tangential belt and the rotorshaft from the braking event while the centrifugal masses are excluded from acting upon the rotorshaft, said sequence being independent of the skill of the operator.

This objective is solved by a device for lifting the belt and by furnishing a lever which is swivelable around an axis, said lever being furnished with a seat which accepts the shaft, the movement of said lever in the direction towards the tangential belt causing lifting of said lever by the device for the lifting-off of the belt and that thereafter the shaft is moved away from the support rolls by means of the seat and is pressed against buffers which are formed as supporting bearings. A brake lining is disposed upon the bearing which supports the shaft, so that said lining furthermore speeds up the process of stopping. Advantageously, the device for lifting off the belt is disposed between the axis of swiveling the lever and the bearing for the shaft. This arrangement causes the path of the belt lift-off roll to move a shorter path than the shaft bearing, so that the length of the path is not much influenced by a severe wear of the bearing or of a lining which might be affixed to said bearing. A predetermined braking force is applied by a spring which engages the free end of the lever, said spring moving said lever in the direction towards the tangential belt due to the lack of a counterforce. The brake lining is beveled in the direction towards the rotor on the side which looks towards the shaft, in order to facilitate the introduction of the rotorshaft into its bearing. Thus, the lift-off path of the shaft is kept constant so that the seats are disposed as friction bearings. The diameter of the friction bearings is proportional to the diameter of the shaft plus the double allowable lift-off path of the shaft.

An embodiment of the invention is explained by the illustrations 1 to 3.

Figure 1:
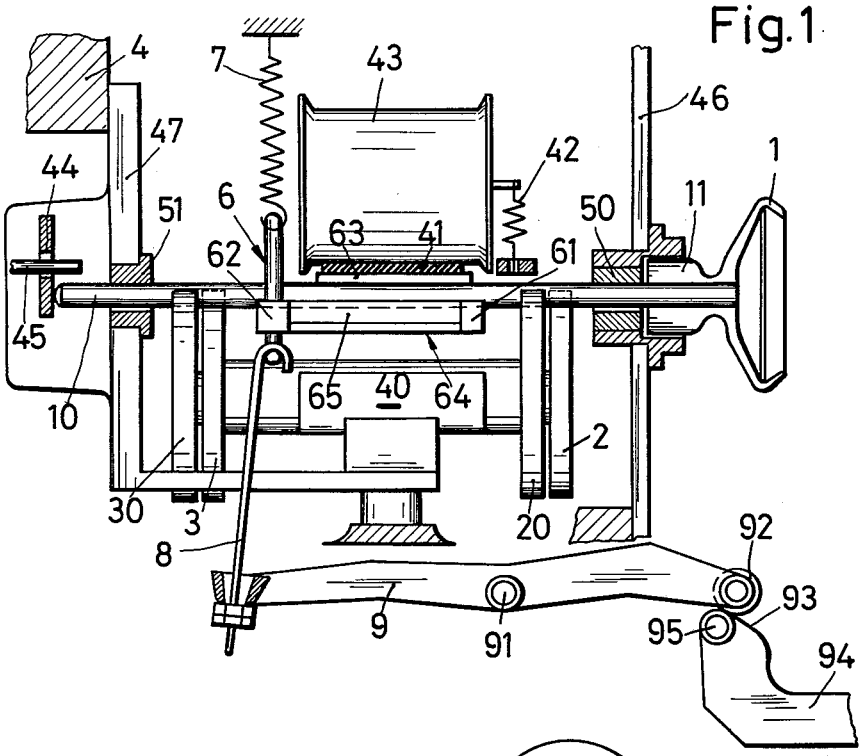
FIG. 1 shows a side elevation of the device according to the invention, partly in a transverse section.
Figure 2:
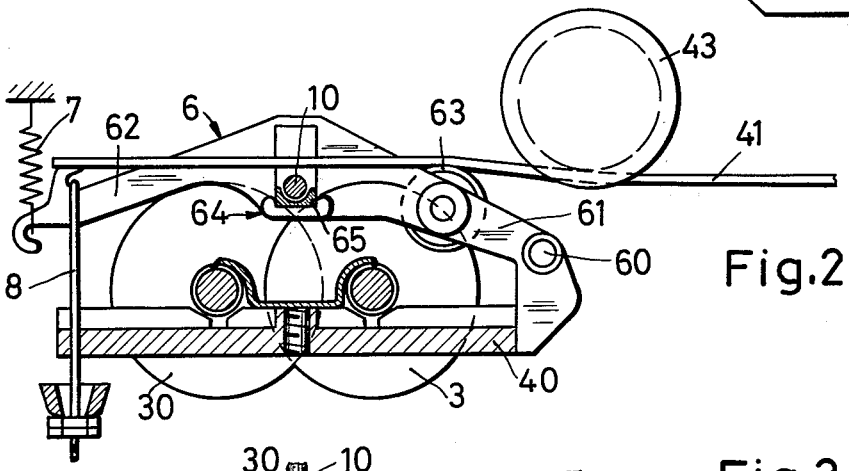
FIG. 2 is a frontal view of the device according to FIG. 1, omitting parts which are immaterial for the invention.
Figure 3:
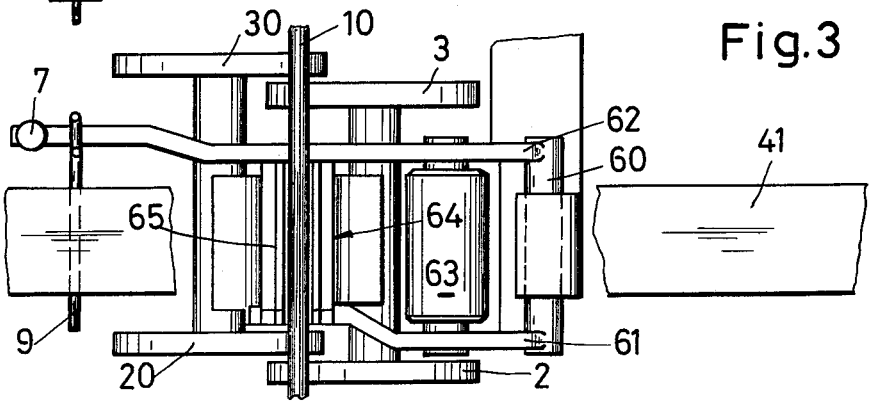
FIG. 3 is a topview of the device according to FIG. 1, also omitting immaterial parts.

The horizontally disposed shaft 10 of the spinning unit of an open-end-spinning machine carries a rotor 1 with a collar 11 and is supported in a slot, said slot being formed by freely rotating pair backing rolls 2, 20 and 3, 30. The backing rolls, 2, 20 and 3, 30, the axles of which are held by a bearing block 40, overlap, thereby reducing the space needed for the support. A tangential belt 41 drives the shaft 10 and the rotor 1, which is fastened to said shaft. A tension roller 43 which is held under pressure by a spring 42 presses the tangential belt 41 against the shaft 10, so that said shaft 10, while operating, is pressed against the backing rolls 2, 20 and 3, 30 and is fastened in a fixed position in the direction of the radius. The position of the shaft 10 in its axial direction is ascertained by the disc 44 which is pivoted upon a stationary axle 45 and against which the shaft 10 is pressed with its free end, as known. The whole bearing's arrangement is disposed within a housing which is as long as the spinning machine of which housing only a part 4 and a panel 46 are shown, said panel 46 limiting said bearing housing towards the rotor 1 (FIG. 1) and being traversed by the shaft 10. The panel 46 forms the rear wall of a closed housing, which forms the spinning chamber (not shown) within which the rotor 1 is disposed, in order to ensure the vacuum which is needed for spinning.

The shaft 10 is arranged in two bearing seats, said seats being practically disposed each in a borehole in the housing rear panel 46 of the spinning chamber and in a bearing plate 47, said plate 47 being fastened within the housing 4. In the embodiment shown, the seats 50 and 51 surround the shaft 10 shaped like rings, and are developed as sliding bearings. Their diameter is proportional to the diameter of the shaft 10 plus the length of the double allowable lift-off path, which the shaft 10 takes while stopping. The allowable lift-off path is no larger than a fraction of a millimeter, in order to exclude or at least to prevent as much as possible the infiltration of air through the annular slot between shaft 10 or collar 11 of the rotor 1 and the seat 50, and that thereby the underpressure situation prevailing within be changed. The seats may also have another practical construction and may have a brake lining instead of slide material. The width of the annular slot between brake linings and the shaft 10 or the collar 11 of the rotor 1 increases steadily when such brake linings are used, a fact which changes unfavorably not only the conditions of lifting off but which also might allow the seeping in of unwanted air into the spinning chamber. Therefore, it is preferable to use seats which are built as slide bearings.

An axle 60 is stationarily disposed in vicinity of the tension roll 43 below the tangential belt 41 and substantially at a right angle to the direction of the running of said belt. A lever 6 pivots upon the axle 60 and is — as later on explained — capable of being moved from a stand-by position in the direction towards the tangential belt 41 into a lift-off position or a stopping position. Both arms 61 and 62 of the lever 6, which are disposed at a distance from each other and which extend in the direction towards the shaft 10, carry a device for the lifting off of the tangential belt 41 from the shaft 10, shaped like a roll 63 and also a seat 64 for the shaft 10, in which case the roll 63 is preferably fastened to the arms 61 and 62 of the lever 6, preferably approximately in the middle between the axle 60 and the seat 64. In order to obtain optimal conditions of lifting off and simultaneously to take account of the given space requirements, the shape of the lever 6 is chosen so that in the stand-by position the seat 64 is further removed from shaft 10 than the roll 63 from the tangential belt. A pan, matching the curvature of the shaft 10 and made out of soft material or two adjacently disposed rolls may be used as a seat, in which latter case, the shaft 10 may rest in the groove between both rollers, when said shaft is lifted off the backing rolls 2, 20 and 3, 30. Preferably though, a brake lining 65 is disposed upon the seat 64, said lining being rounded conforming to the shape of shaft 10.

A spring 7 is disposed at the free end of the arm 62 exerting a steady pull, and endeavoring to move the lever 6 out of its stand-by position in a direction towards the tangential belt into the lifting-off or stopping position (FIG. 1, 2). A tierod 8 holds the lever 6 in the stand-by position, said tierod 8 engaging the free end of the arm 62 and being connected to a two-armed lever which pivots on axle 91. The two-armed lever 9 is here in such a position arrested, that it exerts a pull unto the lever 6, said pull being transferred by the tie rod 8, and being larger than and opposite to the pull of the spring 7. The two-armed lever may be arrested in various ways, preferably though by means of the cover 94 or the spinning chamber housing, said cover 94 pivoting on an axle 95, while a roll 92 of the lever 9 abuts unto the curved part 93 of the spinning chamber housing.

When the housing cover 94 is opened by a given angle, the lever 9 is freed and may pivot on the axle 91, an action which prevents the pull which the lever 9 exerts upon lever 6 and which moves the lever 6 by action of the spring 7 in a direction towards the tangential belt. During this motion, at first the roll 63 lifts the tangential belt 41 completely off the shaft 10 while overcoming the surface pressure of the tension roll 43. Immediately afterwards, the brake lining 65 of the seat 64 engages the shaft 10, lifts the shaft 10 out of the slot between the baking rolls 2, 20 and 3, 30 and presses the shaft 10 against the seats 50 and 51 which form friction bearings. The shaft 10 with the rotor 1 is quickly and safely braked by this braking process which together with the lifting process is released by a single manipulation, when the braking force is exerted unto the shaft 10 while the tangential belt is completely lifted off. The shaft is simultaneously held in a fixed position while the spinning frame stands still.

When the housing cover 94 is closed, the free end of the two-armed lever 9 is pressed upwards by the roll 92 and the lever 6 is pulled in its stand-by position against the pull of the spring 7. This lifts the shaft 10 off the seat 64 and allows it to lie upon the backing rolls 2, 20 and 3, 30. Immediately afterwards the foll 63 frees the tangential belt 41 and is pressed unto the shaft 10 by the tension roll 43.

Sometimes one has to pull the rotor 1 with the shaft 10 out of its bearing, e.g., in order to replace it with another one. In such a case, in order to ensure that the brake lining 65 of the seat 64, which lies in the path where the shaft 10 is pushed in, does not hinder the introduction of the shaft 10, the brake lining 64 is beveled on the side which looks towards the shaft, said bevel sloping towards the rotor 1. The end of the shaft may slide upwards along this bevel and presses simultaneously the lever 6 towards its stand-by position.

We claim:

1. Apparatus for arresting the rotor of an open-end-spinning machine, the shaft of which is supported in a cradle formed by freely rotatable support rollers, and which is pressed and driven against said rollers by a tangential drive belt, comprising a pivotal lever mounted below said shaft and belt, said lever being provided with means for engaging said belt and a seat which receives said shaft, said lever being movable in the direction towards the tangential belt to sequentially lift said belt off the shaft and thereafter carry said shaft away from said support rollers.

2. The apparatus according to claim 1 wherein said shaft is journalled in radial bearing seats which normally permit said shaft to freely rotate, and which engage said shaft when said shaft is carried away from said support rollers.

3. The apparatus according to claim 1, wherein said seat is provided with a brake lining.

4. The apparatus according to claim 8, wherein said lever is mounted about an axle extending transversely to the direction of said belt and said means for engaging said belt is located thereon between said axle and said seat.

5. The apparatus according to claim 1, including spring means for normally biasing said lever in the direction toward said belt.

6. The apparatus according to claim 5, wherein said rotor is located in a housing having a pivotal cover, and means are provided coacting with said cover for applying a counterforce on said lever against to said spring means for moving said lever in a direction away from said belt permitting said belt to engage said shaft and said shaft to engage said support rollers.

7. The apparatus according to claim 1, wherein said seat is beveled in direction towards the rotor.

8. The apparatus according to claim 2, wherein said radial bearing seats are formed as friction bearings.

9. The apparatus according to claim 2, wherein the diameter of said radial bearing seats is equal to the diameter of the shaft plus double the length of the allowable lift-off path of the shaft.

* * * * *